US005937909A

United States Patent [19]

Clauss et al.

[11] Patent Number: 5,937,909

[45] Date of Patent: Aug. 17, 1999

[54] THROTTLE ELEMENT FOR A VEHICLE

[75] Inventors: Helmut Clauss; Bernd Rosenau, both of Tamm, Germany

[73] Assignee: Robert Bosch GmbH, Stuttgart, Germany

[21] Appl. No.: 09/095,613

[22] Filed: Jun. 11, 1998

[30] Foreign Application Priority Data

Jun. 11, 1997 [DE] Germany ..... 297 10 159

[51] Int. Cl.[6] ..... F15D 1/02

[52] U.S. Cl. ..... 138/43; 138/44; 138/45

[58] Field of Search ..... 138/43, 44, 45

[56] References Cited

U.S. PATENT DOCUMENTS

| | | | |
|---|---|---|---|
| 2,501,593 | 3/1950 | Becker | 138/44 |
| 2,840,112 | 6/1958 | Yarnall et al. | 138/43 |
| 3,473,781 | 10/1969 | Abbott et al. | 138/43 |
| 3,921,672 | 11/1975 | Arnold | 138/44 |
| 3,934,812 | 1/1976 | Pett | 138/43 |
| 5,123,452 | 6/1992 | LeBlanc | 138/44 |

FOREIGN PATENT DOCUMENTS 41 42 998 C1 7/1993 Germany .

*Primary Examiner*—James F. Hook
*Attorney, Agent, or Firm*—Edwin E. Greigg; Ronald E. Greigg

[57] ABSTRACT

A throttle element for installation in a fuel carrying conduit, which is embodied as a screwed in insert with a head that constitutes an annular gap in relation to a cylindrical circumference wall of the conduit and this annular gap is disposed as a filter upstream of the throttle of the throttle element.

3 Claims, 1 Drawing Sheet

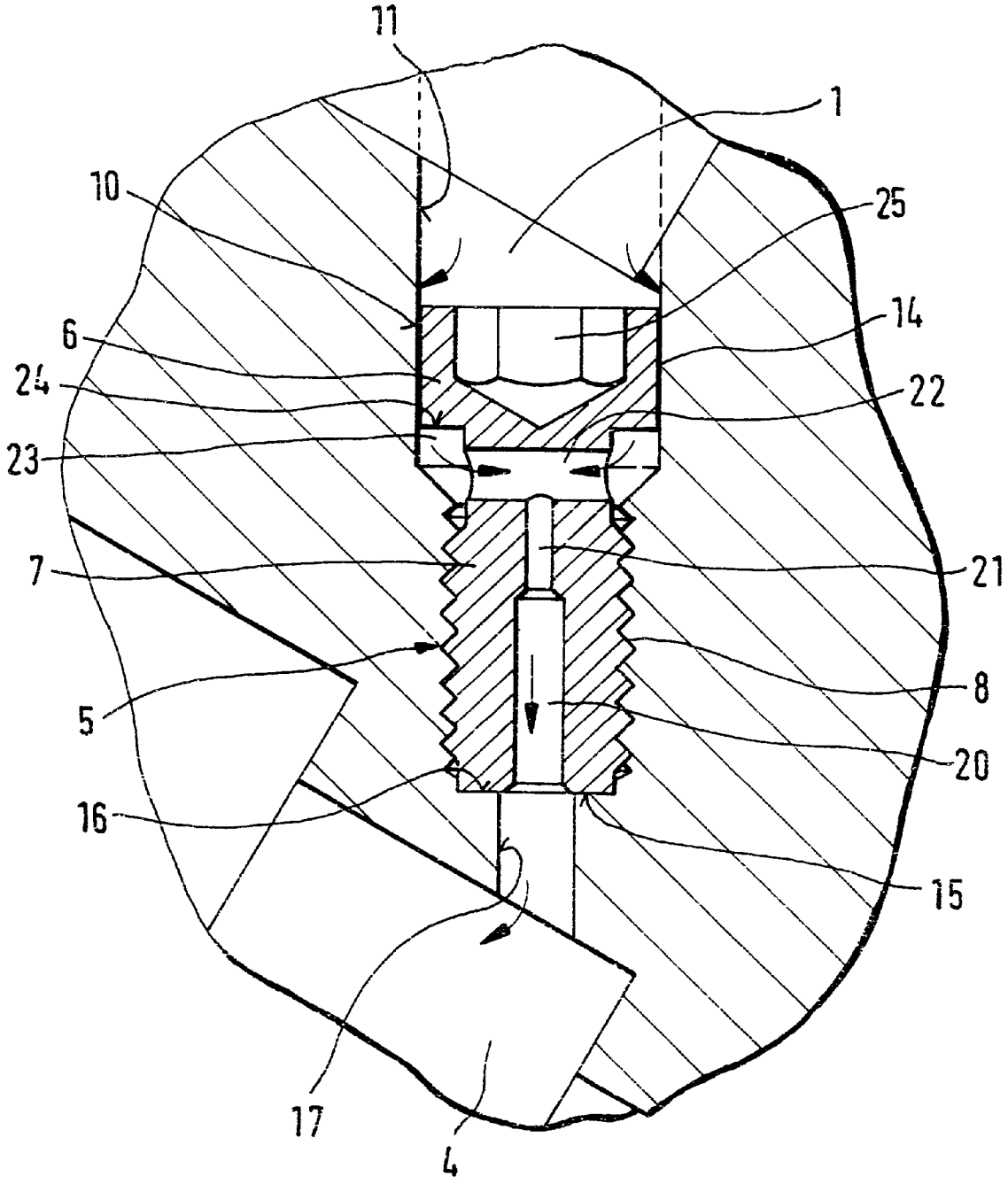
11
1
10
25
14
6
24
22
23
7
21
8
5
20
16
15
17
4

THROTTLE ELEMENT FOR A VEHICLE

BACKGROUND OF THE INVENTION

The invention is based on a throttle element for a vehicle. A throttle element of this kind has been disclosed by DE-C1-41 42 998, in which the throttle opening is embodied as coaxial to the cylindrical insert and press-fitted into a conduit so that with regard to the total length, the circumference wall of the throttle element constitutes an end of the conduit. This kind of throttle elements have the disadvantage that they can be affected by dirt particles during operation so that the liquid flow is impeded.

OBJECT AND SUMMARY OF THE INVENTION

Through the embodiment according to the invention, as defined hereinafter, it will now be assured that on the inflow side of the throttle element, a filter precedes the throttle, which assures that dirt particles that are brought in the liquid flow are filtered out immediately upstream of the throttle. It is advantageous that the filter is an annular gap that is in fact cross sectionally larger than the cross section of the throttle, but due to the great length of the annular gap, the gap width can be kept very small.

The invention will be better understood and further objects and advantages thereof will become more apparent from the ensuing detailed description of preferred embodiments taken in conjunction with the drawing.

BRIEF DESCRIPTION OF THE DRAWING

The sole FIGURE. shows a partial detail of a fuel injection system.

DESCRIPTION OF THE PREFERRED EMBODIMENTS

In FIG. 1, a partial detail of a fuel injection system is reproduced, which has a conduit 1 that carries fuel at low pressure and conducts the fuel to a chamber, not shown in detail here, which must be kept free of impurities, wherein the influx into the chamber should have the ability to be metered by way of a throttle. A throttle element in the form of an insert 5 is screwed into the conduit 1 in order to carry out this metering of a fuel delivery quantity through this conduit 1. This insert 5 has a head 6 and a screw part 7, which is screwed with its external thread into a corresponding thread of a threaded part 8 of the conduit. The thread of the screw part 7 has a smaller outer diameter than the head 6, which is embodied cylindrically and with its cylindrical circumference wall 10, constitutes an annular gap 14 in relation to the cylindrical wall 11 of the conduit.

The screw part 7 ends in a flat end face 15, which when the insert is screwed in, rests tightly against a shoulder 16 of the conduit between the threaded part 8 and a continuing conduit part 17 that is diametrically reduced in comparison to the external thread of the threaded part 8. Consequently, a sealing of the connection between the two sides of the insert 5 can take place at the thread or at the shoulder.

From the end face 16, an axial bore 20 enters into the screw part 7. At its end, this bore transitions into a throttle bore 21, which in turn feeds into a lateral bore 22. The end face 16 of the insert, as part of an opening through the insert, is connected by way of this lateral bore to an annular chamber 23 formed between this insert and the wall 11 of the conduit when this insert is screwed in. To this end the insert has an indent 24 between the head 6 and the screw part 7. On the end face, the head has an internal hex opening (25) for receipt of a hex tool for installing the insert in the conduit.

The annular gap 14, as another part of the opening through the insert, has a total through flow cross section that is greater than the through flow cross section of the throttle 21. However since this greater cross section of the annular gap is distributed over the entire circumference wall 10 of the head 6, a gap width is produced that is significantly smaller than the inner diameter of the throttle 21. Due to this property, the annular gap 14 is extremely well suited for filtering the fuel flowing through the insert. The filter location precedes the throttle in the flow direction and catches all dirt particles that could impair the function of the throttle 21.

The foregoing relates to preferred exemplary embodiments of the invention, it being understood that other variants and embodiments thereof are possible within the spirit and scope of the invention, the latter being defined by the appended claims.

We claim:

1. A throttle element for installation in a fuel carrying conduit (1), said throttle element includes a throttle (21) which limits a stream of liquid flowing through the throttle element, wherein the throttle element is embodied as an insert (5) in a conduit (1) that carries fuel at low pressure and conducts the fuel to a chamber, the throttle element has a part (7) that is disposed in a sealed fashion in the conduit (1), wherein between two parts of the insert, an opening is provided that contains the throttle (21), the insert has a screw part (7) and a head (6), and said screw part (7) is screwed into a threaded part (8) of the conduit and constitutes a part which is disposed in a sealed fashion on a shoulder 16 in the conduit and along the threads (8), wherein the head (6) of the insert (5) disposed upstream of the screw part (7) has a cylindrical circumference wall (10), which in conjunction with said head (6) constitutes an annular gap (14) in relation to the wall (11) of the conduit (1) along which fuel flows, said annular gap (14) functions as a fuel filter along said head (6), and as another part of the opening, an inlet (22, 23) on the insert (5) forms a chamber between the head (6) and the screw part (7), and this inlet chamber is connected to an axial bore (20) that contains the throttle (21) and leads to a side of the insert disposed downstream of the annular gap.

2. A throttle element according to claim 1, in which the head (6) has an internal hex (25) on its upstream end.

3. A throttle element according to claim 2, in which an indent (24) is provided between the head (6) and the screw part (7) of the insert (5) and a bore (22) leads diametrically to the axial bore (20, 21) from this indent.

* * * * *